United States Patent [19]

Schweiger

[11] Patent Number: 4,773,580

[45] Date of Patent: Sep. 27, 1988

[54] DEVICE FOR TRANSMITTING MOTION TO WEBS OF PHOTOGRAPHIC MATERIAL IN DEVELOPING MACHINES AND THE LIKE

[75] Inventor: Ernst Schweiger, Munich, Fed. Rep. of Germany

[73] Assignee: Agfa-Gevaert Aktiengesellschaft, Leverkusen, Fed. Rep. of Germany

[21] Appl. No.: 913,870

[22] Filed: Oct. 1, 1986

[30] Foreign Application Priority Data

Oct. 8, 1985 [DE] Fed. Rep. of Germany ..... 3535852

[51] Int. Cl.[4] ..... B65H 20/16; G03D 13/10

[52] U.S. Cl. ..... 226/92; 354/345

[58] Field of Search ..... 226/92, 91, 170; 354/322, 321, 345; 24/DIG. 8, DIG. 9, 585, 237

[56] References Cited

U.S. PATENT DOCUMENTS

| | | | |
|---|---|---|---|
| 628,529 | 7/1899 | Gathright | 24/237 X |
| 1,618,384 | 2/1927 | Morris | 24/DIG. 9 |
| 2,034,659 | 3/1936 | Laencher | 24/DIG. 9 |
| 2,609,629 | 9/1952 | Hubbard | 24/DIG. 9 |
| 4,065,042 | 12/1977 | Zielinski | 226/92 |
| 4,188,108 | 1/1980 | Falomo | 226/92 X |
| 4,330,191 | 5/1982 | Rawlings et al. | 226/92 X |

FOREIGN PATENT DOCUMENTS

| | | |
|---|---|---|
| 1154040 | 9/1963 | Fed. Rep. of Germany . |
| 2603659 | 2/1981 | Fed. Rep. of Germany . |
| 2512826 | 11/1983 | Fed. Rep. of Germany . |

*Primary Examiner*—Stuart S. Levy
*Assistant Examiner*—Lynn M. Sohacki
*Attorney, Agent, or Firm*—Peter K. Kontler

[57] ABSTRACT

A clip which is to separably couple an elastic belt conveyor with the leader of a web of photographic material has a slotted arm which is connectable to the leader and a frame which is integral with one end of the arm and has a square window bounded at two of its sides by triangular or square projections. The belt conveyor is caused to buckle so as to reduce its effective width, and one of its marginal portions is inserted in front of one of the projections from one side of the frame prior to insertion of the other marginal portion in front of the other projection. The projections engage one side of the conveyor and the other side of the conveyor is engaged by one side of the frame in front of and behind the window. The clip is flat and its arm is integral with the frame. The width of the window in the frame is somewhat less than the width of the conveyor.

22 Claims, 2 Drawing Sheets

DEVICE FOR TRANSMITTING MOTION TO WEBS OF PHOTOGRAPHIC MATERIAL IN DEVELOPING MACHINES AND THE LIKE

BACKGROUND OF THE INVENTION

The invention relates to improvements in devices for transmitting motion to webs of flexible material (such as webs of photographic film or photographic paper) in processing machines. More particularly, the invention relates to improvements in motion transmitting devices known as, or often called, clips which can be used to temporarily attach webs of photographic paper or the like to an endless belt conveyor serving to transport the webs through a developing or like machine.

German Auslegeschrift No. 1,154,040 discloses a clip having a first portion of springy metallic material and an arm which is made of the same material. The first portion has a first hook which is remote from and two additional hooks which are adjacent to the arm. The flexible belt conveyor is flanked by the first hook at one of its marginal portions and by the additional hooks at the other marginal portion. The hooks constitute bent pieces of metallic stock which are spot welded to the first portion of the clip. This contributes to the cost of the clip. Moreover, the connection between the hooks and the conveyor is not always reliable because it depends on the width of the channel between the first hook and the additional hooks as well as upon the stiffness of the conveyor (i.e., on the force with which the slightly deformed conveyor bears against the hooks when it is introduced into the channel). Transverse deformation (buckling) of the conveyor in the longitudinal direction should not be very pronounced because the conveyor is trained over several pulleys and, therefore, it must exhibit a substantial amount of flexibility so that it can reliably follow the path which is defined by the pulleys in a developing machine for photographic films, photographic paper and the like.

OBJECTS AND SUMMARY OF THE INVENTION

An object of the invention is to provide a device which can releasably but reliably couple the leader of a web of photographic or other material to a flexible belt conveyor in such a way that it can transmit substantial entraining forces, that it can be rapidly and readily detached from the conveyor and/or from the leader of the web, and that it can be used in conjunction with the conveyors of existing web processing apparatus or machines.

Another object of the invention is to provide a motion transmitting device which is not only simple but also lightweight, durable, inexpensive and compact.

A further object of the invention is to provide a device which can be used jointly with or in lieu of heretofore known clips for the leaders of webs of photographic films or photographic paper in developing and like machines.

An additional object of the invention is to provide a novel and improved method of transporting elongated flexible webs through processing machines.

Still another object of the invention is to provide a machine which allows for the utilization of the above outlined motion transmitting device.

The invention is embodied in a device for transmitting motion from a flexible belt conveyor having a predetermined width to a web of photographic material or the like in a processing machine (e.g., in a machine for developing exposed photographic films or photographic paper) wherein the conveyor is arranged to advance in a predetermined direction. The improved device comprises a first section which is connectable with the web and a second section which is separably connectable with the conveyor. The second section includes a frame defining a window of a length and a width at least approximating the width of the conveyor, and the frame has a first side, a second side and a pair of elongated edge faces bounding the window and extending in the predetermined direction when the second section is connected to the conveyor. The second section further comprises a projection extending into the window from each of the edge faces, and the conveyor is connected to the second section in such a way that it extends from one side of the frame, through the window, along the projections at the other side of the frame, back through the window and along the one side of the frame.

The sections are or can be substantially flat and coplanar and integral with each other.

The width of the window can be slightly less than the width of the conveyor, e.g., the width of the conveyor can exceed the width of the window by less than five percent (preferably by approximately two percent).

The edge faces of the frame are or can be longer than the projections; for example, the length of each projection can be approximately 80 percent of the length of the respective edge face. At least one of the projections can have a substantially triangular shape with a base which is adjacent the respective edge face and a preferably rounded apex. Such projections can be mirror symmetrical to each other. At least one of the projections can extend into the window (i.e., toward the other edge face) through a distance between substantially one-tenth and one-fourth of the width of the conveyor, e.g., through a distance which is approximately 20 percent of the width of the conveyor. The height of one of the projections can exceed the height of the other projection; the height of the one projection can be approximately 50 percent and the height of the other projection can be approximately 20 percent of the width of the conveyor. The first section can constitute an elongated arm which extends transversely of the direction of movement of the conveyor and from one side of the conveyor when the latter is connected to the second section of the motion transmitting device. The other projection (of lesser height) is preferably disposed between the one projection and the first section.

At least one of the two sections can be made of or can contain stainless steel. Alternatively, at least one of the sections can be made of or can contain a temperature- and corrosion-resistant plastic material (such as polypropylene).

The frame can be provided with an external finger-receiving notch in that portion thereof which is remotest from the first section.

The first section can be provided with one or more elongated slots which extend substantially transversely of the direction of advancement of the conveyor when the second section is connected to the conveyor, and such slots serve to facilitate rapid attachment of the web to, as well as rapid detachment of the web from, the first section. The length of the slots preferably exceeds the width of the web, and the width of the slots preferably matches or exceeds the thickness of the web.

The novel features which are considered as characteristic of the invention are set forth in particular in the appended claims. The improved motion transmitting device itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

FIGS. 1 to 4 show a motion transmitting device MT (hereinafter called clip for short) which comprises a first section in the form of an elongated arm 1*a* and a second section 1 including or constituting a substantially square or slightly rectangular frame having a window 1*c* flanked by two edge faces 1*c'* extending in the longitudinal direction of an elongated flexible elastic belt conveyor 2 which serves to advance a web 3 of photographic material through a conventional developing or other treating or processing machine, not shown. The direction in which the conveyor 2 is driven when the machine is in use is indicated by an arrow 2*a*. The arm 1*a* extends transversely of such direction and is formed with two elongated parallel slots 1*b* each having a length slightly exceeding the width of the leader of the web 3 and a width which preferably at least equals and most preferably greatly exceeds the thickness of the web 3.

Figure 1:
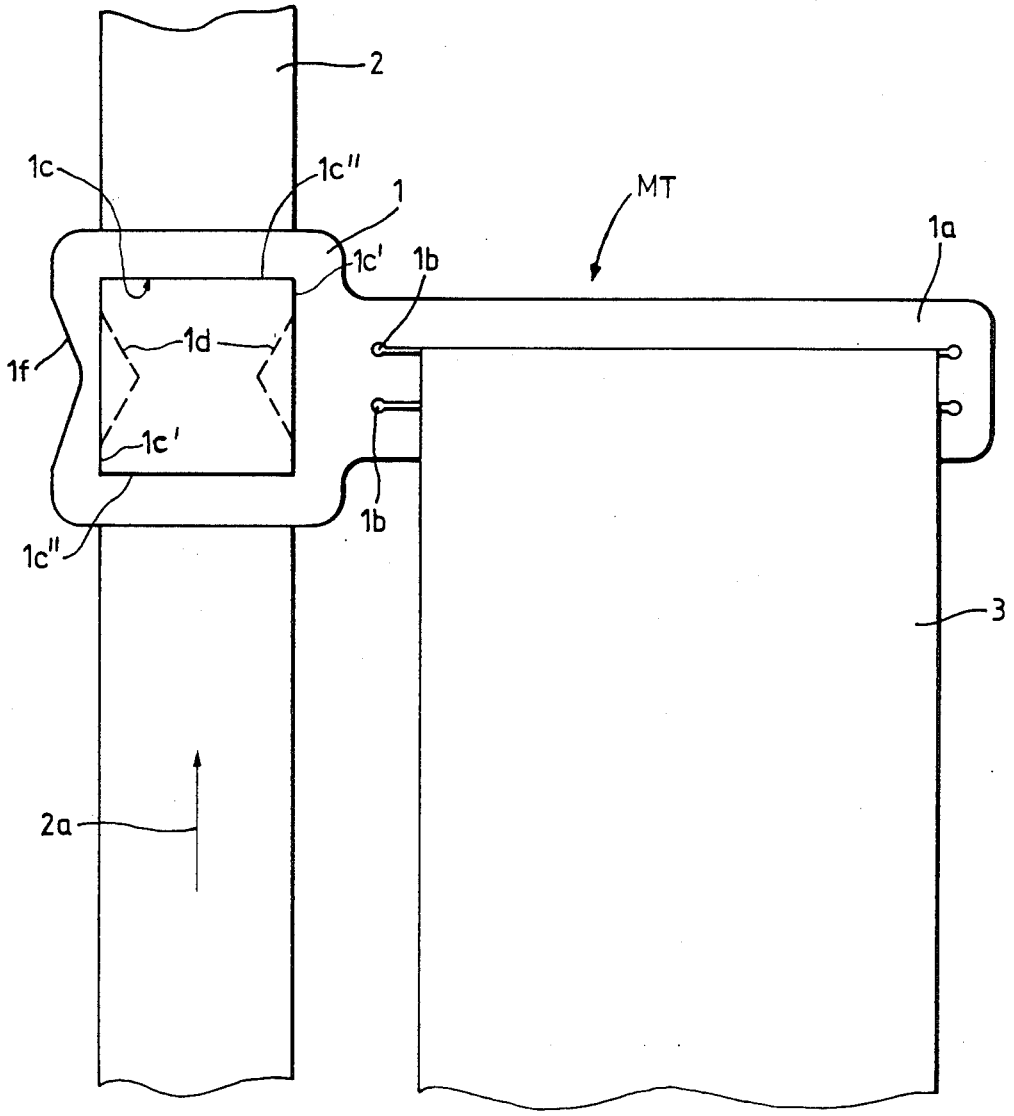
FIG. 1 is a plan view of a portion of a belt conveyor, of the leader of a web of photographic material, and of a motion transmitting device which separably couples the web to the conveyor.

The conveyor 2 is made of a material which can stand the temperatures and the corrosive action of fluids in a developing machine for photographic paper, photographic films and the like. The same applies for the material of the clip 1 which can be made of stainless steel or from a suitable temperature- and corrosion-resistant synthetic plastic material, such as polypropylene. FIG. 1 is drawn to size and the web 3 is assumed to constitute a strip of photographic paper which is to be transported through a developing machine prior to being subdivided into prints of predetermined size. The conveyor 2 can have a thickness of approximately 0.8 mm and is sufficiently flexible to be readily flexed (looped) through an angle of 180° about a pulley whose diameter is or approximates 50 mm. The distance between the right-hand marginal portion of the conveyor 2 and the left-hand marginal portion of the web 3 (as seen in FIG. 1) is approximately half the width of the conveyor 2. The web 3 travels around a discrete set of rolls or pulleys which are provided in the developing machine and enable the web to remain substantially parallel to the conveyor 2. A suitable construction of pulleys for a flexible belt conveyor and for a web of photographic paper or the like is disclosed in German Pat. No. 26 03 659. Pulleys of the type disclosed in this German patent are particularly suitable when the web is to advance along a relatively long path.

The frame 1 is preferably flat, the same as the arm 1*a*, and these sections of the improved clip MT are preferably (or can be) integral and coplanar with each other. This can be seen in FIG. 3.

Figure 2:
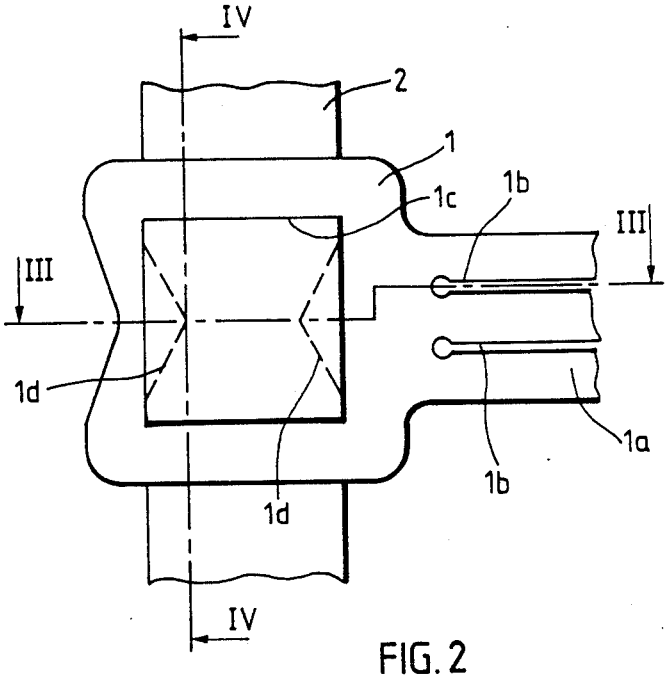
FIG. 2 is a slightly enlarged plan view of a portion of the structure which is shown in FIG. 1.

The end portions of the slots 1*b* in the arm 1*a* are preferably bounded by circular surfaces (as shown in FIGS. 1 and 2) in order to reduce the likelihood of the development of so-called notch stresses. In order to separably connect the web 3 to the arm 1*a*, the leader of the web 3 is introduced into the upper slot 1*b* from the front side of the arm (as seen in FIG. 1), the leader is then introduced through the lower slot 1*b* from the rear side of the plane of FIG. 1 and is flexed to extend counter to the direction of arrow 2*a*, and such leader is then flexed to overlie the front side of the arm below the lower slot 1*b*. This establishes a reliable temporary connection between the web 3 and the arm 1*a* so that the web shares all movements of the conveyor 2 in the direction of the arrow 2*a*. Such entrainment of the web 3 is ensured by friction which is generated between the arm 1*a* and the leader of the web, especially when the web is under tension.

The clip MT is or can be very thin if its sections 1, 1*a* are made of stainless sheet steel stock. The thickness of the clip is likely to be greater if the sections 1 and 1*a* are made of a plastic material. The exact thickness of a plastic clip will depend upon the nature of the plastic material and on the desired stability and strength of the clip. A plastic clip can be made in an injection molding machine and its material can be polypropylene, a polycarbonate or a polyamide. The thickness of the clip (especially the thickness and other dimensions of the frame 1) is preferably or can be selected in such a way that the force which is applied by the conveyor 2 in actual use entails no deformation or only negligible deformation, of the clip.

The means for separably coupling the frame 1 to the adjacent portion of the conveyor 2 comprises two mirror symmetrical triangular projections or lugs 1*d* whose bases extend along the respective edge faces 1*c'* in the window 1*c* and whose apices extend into the window 1*c* and toward each other. The edge faces 1*c'* are parallel to the direction which is indicated by the arrow 2*a*. The width of the belt conveyor 2 preferably exceeds the width and length of the window 1*c* by less than five percent, most preferably by approximately two percent. The length of the window 1*c* (as seen in the direction of the arrow 2*a*) can match or closely approximate the width of the window, i.e., the window can have a substantially square outline. Each of the projections 1*d* resembles an isosceles triangle whose height (as measured at right angles to the direction of the arrow 2*a*) is between one-tenth and one-fourth (most preferably approximately one-fifth) of the width of the window 1*c*. The length of the edge faces 1*c'* exceeds the length of the bases of the respective triangular projections; for example, the length of each edge face 1*c'* can exceed the length of the base of the respective triangular projection 1*d* by approximately 20 percent and each projection is or can be located substantially midway between the ends of the respective edge face.

A finger receiving notch 1*f* is provided in the external marginal portion of the frame 1 at a location which is remotest from the arm 1*a*. The making of such notch entails a saving in the material of the clip MT and facilitates its manipulation, especially during attachment of the frame 1 to and its detachment from the conveyor 2.

The arm 1*a* can be caused to extend to the right-hand side (as actually shown in FIG. 1) or to the opposite side of the conveyor 2, depending on the selection of the path for travel of the web 3 through the processing machine. The projections 1*d* can engage and hold the adjacent portion of the conveyor 2 regardless of the direction in which the arm 1*a* extends.

Figure 4:
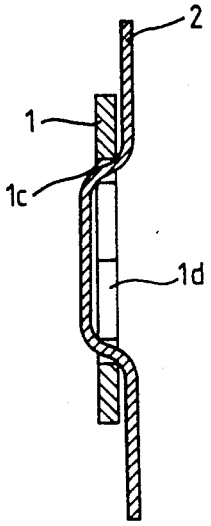
FIG. 4 is a sectional view as seen in the direction of arrows from the line IV—IV of FIG. 2.
Figure 3:
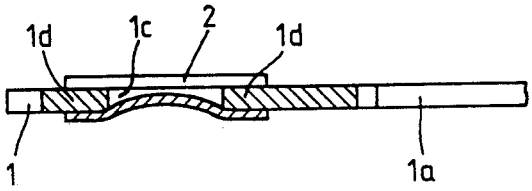
FIG. 3 is a sectional view as seen in the direction of arrows from the line III—III of FIG. 2.

The manner of connecting the frame 1 of the improved clip MT to a straight stretch or reach of the belt conveyor 2 is as follows:

In the first step, the leader of the web 3 is separably connected to the arm 1*a* in the aforedescribed manner so that the leader engages the arm by friction and remains engaged with the arm while the clip is caused to advance with the conveyor 2. One hand of the person in charge holds the arm 1*a* and the other hand is used to buckle the conveyor 2 in the longitudinal direction so that the width of the conveyor is reduced. The frame 1 is located in front of the conveyor 2, and the left hand is used to insert one marginal portion of the conveyor in front of the left-hand projection 1*d*. The left hand is then used to insert a finger into the notch 1*f* and to again buckle the conveyor 2 so that its right-hand marginal portion can be inserted in front of the right-hand projection 1*d*. This completes the attachment of the frame 1 to the conveyor 2. The latter then extends along the rear side of the frame 1, through the window 1*c* and forwardly toward the observer of FIG. 1, along the front side of the frame 1, through the window 1*c* and away from the observer of FIG. 1, and again along the rear side of the frame 1. The configuration of that portion of the conveyor 2 which extends along the two sides of the frame 1 and twice through the window 1*c* is shown in FIGS. 3 and 4. Since the conveyor 2 is wider than the window 1*c*, its marginal portions bear against the respective edge faces 1*c*'. At the same time, the conveyor 2 is in frictional engagement with the frame all around the window 1*c* as well as with the front sides of the projections 1*d*.

If desired, the clip MT can be separably attached to the conveyor 2 by a semiautomatic or automatic apparatus, e.g., in a manner as disclosed in German Pat. No. 25 12 826 which proposes to use rollers as a means for engaging the marginal portions of the belt conveyor and for thereupon reducing the width of the conveyor.

It has been found that the conveyor portion which is deformed in a manner as shown in FIGS. 3 and 4 ensures the establishment of a highly satisfactory retaining action so that the frame 1 does not slide along the conveyor 2 when the latter is driven to advance through a developing or other processing machine. The deformed portion of the conveyor 2 is in pronounced frictional engagement with the frame 1 along both transversely extending edge faces 1*c*'', along the exposed portions of the edge faces 1*c*' as well as along the front sides of the projections 1*d*. The once deformed portion of the conveyor 2 resists additional deformation and retains the shape which is shown in FIGS. 3 and 4. The conveyor 2 is or can be made of a plastic material which is of additional advantage, especially if the frame 1 is also made of a plastic material, because the pressure per unit area of such plastic bodies is limited so that the wear upon and/or other damage to the conveyor is negligible or non-existent. The improved clip MT is highly unlikely to damage or cause excessive wear upon the conveyor 2 even if the frame 1 is made of a metallic material.

The frame 1 can be automatically separated from the conveyor 2 at the outlet of or externally of the processing machine, e.g., by causing a stationary wedge to penetrate between the frame 1 and the respective side of the conveyor 2 substantially midway between the rounded tips of the projections 1*d*. Alternatively, the conveyor 2 can be separated from the frame 1 in response to the application of pressure to its marginal portions so as to reduce the width of the conveyor and to thus enable a person to separate the marginal portions from the projections 1*d* by pulling the conveyor rearwardly and away from the plane of FIG. 1 and/or by pulling or pushing the frame 1 forwardly and toward the observer of FIG. 1.

The illustrated triangular projections 1*d* can be replaced with other types of projections (e.g., with trapezoidal or analogous projections) without departing from the spirit of the invention. The tips, apices, corners and analogous protruding parts of the projections are or can be rounded to thus reduce the likelihood of injury to the person in charge and/or damage to the conveyor 2.

The length of the window 1*c* (in the direction of the arrow 2*a*) can exceed or can be less than the width of the conveyor 2. A window which is too long is not as satisfactory as a substantially rectangular window because the frame is too long and cannot be readily guided around the pulleys for the conveyor 2. If the window 1*c* is too short, and if a relatively short frame is to remain in satisfactory frictional engagement with the conveyor, the relatively short projections are more likely to exert a substantial pressure upon the adjacent portions of the conveyor.

The edge faces bounding the window 1*c* should be carefully treated (particularly deburred and rounded) in order to reduce the likelihood of extensive wear upon and/or other damage to the conveyor 2.

Figure 5:
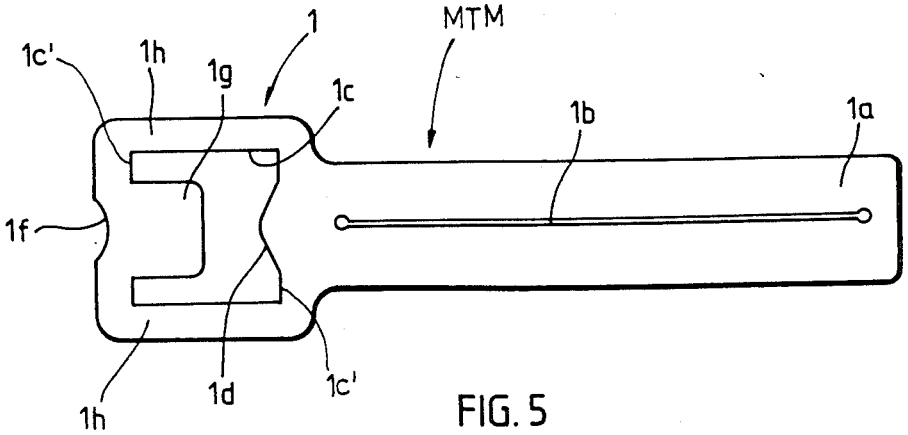
FIG. 5 is a plan view of a modified motion transmitting device.

FIG. 5 shows a modified motion transmitting device or clip MTM wherein the arm 1*a* has a single elongated slot 1*b* and the frame 1 includes a substantially triangular projection 1*d* facing a substantially square or slightly rectangular projection 1*g* having two rounded corners. The triangular projection 1*d* is located between the arm 1*a* and the projection 1*g*. The length of the projection 1*g* in the direction of travel of the conveyor 2 (not shown in FIG. 5) is or can be approximately three-fifths of the length of the respective edge face 1*c*', and the same applies for the projection 1*d*. This leaves ample room for engagement of the exposed portions of the edge faces 1*c*' by the adjacent marginal portions of a properly inserted belt conveyor. The height of the projection 1*g* (in a direction from the notch 1*f* toward the arm 1*a*) is or can approximate half the width of the window 1*c*. The height of the triangular projection 1*d* can be a fraction of the height of the projection 1*g*.

In order to attach the clip MTM to a straight portion of the conveyor 2, the thumb of the left hand of the operator is used to flex the projection 1*g* slightly rearwardly (behind the plane of FIG. 5) so that the conveyor (which is located behind the plane of FIG. 5) can be pushed to the left until its left-hand marginal portion abuts the left-hand edge face 1*c*'. The thumb of the left hand is then used to press the conveyor against the front side of the projection 2*g*, and the index finger of the same hand is inserted into the notch 1*f* and is used to press against the rear side of the projection 1*g* so that the conveyor portion overlying the projection 1g is clamped between such projection and the thumb of the left hand. The projection 1g is thereby forced forwardly with simultaneous flexing of the walls 1h surrounding the window 1c of FIG. 5. The right-hand marginal portion of the conveyor is caused to move in front of the triangular projection 1d so that it abuts the right-hand edge face 1c' in the window 1c. Such manipulation of the right-hand marginal portion of the conveyor is effected by a finger of the hand which holds the arm 1a.

The clip MTM can be used with equal advantage for attachment to a conveyor in such a way that the frame 1 is located to the right of the arm 1a.

An advantage of the improved clip is its simplicity and hence its reasonable cost. The clip can be stamped out of flat metallic or plastic blanks or it can be made in an injection molding or other suitable machine of conventional design. The entire clip can constitute a single piece of metallic or plastic material with no welded seams or other cost-increasing features. The transfer of forces between the frame and the conveyor is satisfactory regardless of the speed at which the conveyor 2 is driven, and the same applies for the connection between the arm 1a and the leader of a web of photographic material or the like. The conveyor engages the frame 1 all around the window 1c so as to ensure the establishment of pronounced friction which prevents the conveyor from sliding relative to the frame and/or vice versa. The conveyor abuts against one side of the frame 1c ahead of as well as behind the window 1c (at least while the conveyor portion adjacent the frame is flat) to further enhance the friction between the conveyor and the frame. Bending of a portion of the conveyor out of its general plane in the region of the window 1c (note FIGS. 3 and 4) ensures the establishment and maintenance of pronounced friction which is desirable and advantageous in connection with such clips. In spite of such pronounced friction, the pressure per unit area of the marginal portions of the conveyor is not sufficiently high to entail pronounced wear upon and/or other damage to the marginal portions.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of the aforedescribed contribution to the art and, therefore, such adaptations should and are intended to be comprehended within the meaning and range of equivalence of the appended claims.

What is claimed is:

1. The combination of a flexible belt conveyor having a predetermined width with a device for transmitting motion from the conveyor to a web of photographic material or the like in a processing machine wherein the conveyor is arranged to advance in a predetermined direction, said device comprising a first section connectable with the web and a second section separably and repeatedly connectable with the conveyor in response to deformation of the conveyor, said second section including a frame defining a window of a length and width at least approximately said predetermined width, said frame having a first side, a second side and a pair of elongated edge faces bounding said window and extending in said direction when said second section is connected with said conveyor, said second section further having a projection extending into said window from each of said edge faces and the conveyor extending from one of said sides, through said window, along said projections at the other of said sides, back through said window and along said one side when said second section is connected to the conveyor, said conveyor having a portion which registers with said window and is flexed by said second section in as well as transversely of said direction when said second section is connected to the conveyor.

2. The combination of claim 1, wherein said sections are substantially flat and coplanar and integral with each other.

3. The combination of claim 1, wherein the width of said window is slightly less than said predetermined width.

4. The combination of claim 3, wherein said predetermined width exceeds the width of said window by less than five percent.

5. The combination of claim 1, wherein said edge faces are longer than the respective projections.

6. The combination of claim 5, wherein the length of said projections in said direction is approximately 80 percent of the length of the respective edge faces.

7. The combination of claim 1, wherein at least one of said projections has a substantially triangular shape.

8. The combination of claim 7, wherein said one projection has a base adjacent to the respective edge face and a rounded apex.

9. The combination of claim 1, wherein said projections are substantially mirror symmetrical to each other.

10. The combination of claim 1, wherein at least one of said projections extends into said window through a distance between substantially one-tenth and one-fourth of said predetermined width.

11. The combination of claim 10, wherein said distance is approximately 20 percent of said predetermined width.

12. The combination of claim 1, wherein the height of one of said projections transversely of said direction exceeds the height of the other of said projections.

13. The combination of claim 12, wherein the height of said one projection is approximately 50 percent and the height of said other projection is approximately 20 percent of said predetermined width.

14. The combination of claim 12, wherein said first section extends transversely of said direction from one side of the conveyor when the latter is connected to said second section, said other projection being disposed between said one projection and said first section.

15. The combination of claim 1, wherein said sections contain stainless steel.

16. The combination of claim 1, wherein said sections contain a corrosion- and temperature-resistant plastic material.

17. The combination of claim 16, wherein said plastic material is polypropylene.

18. The combination of claim 1, wherein said first section is disposed at one side of the conveyor when the conveyor is connected to said second section, said frame having an external finger-receiving notch opposite said first section.

19. The combination of claim 1, wherein said first section has at least one elongated slot extending substantially transversely of said direction when said second section is connected to the conveyor.

20. The combination of claim 19 for transmitting motion to a web of preselected thickness and width, wherein the length of said slot exceeds said preselected width and the width of said slot at least matches said preselected thickness.

21. The combination of claim 1, wherein said sections consist of stainless steel.

22. The combination of claim 1, wherein said sections consist of a corrosion- and temperature-resistant plastic material.

* * * * *